United States Patent [19]

Reznik

[11] Patent Number: 4,680,871

[45] Date of Patent: Jul. 21, 1987

[54] APPARATUS AND METHOD FOR DRYING AND CURING COATED SUBSTRATES

[76] Inventor: David Reznik, 2151 Barbara Dr., Palo Alto, Calif. 94303

[21] Appl. No.: 735,366

[22] Filed: May 17, 1985

[51] Int. Cl.[4] ..... F26B 3/347

[52] U.S. Cl. ..... 34/1; 219/10.49 R; 219/10.79

[58] Field of Search ..... 34/1; 219/10.49 R, 10.79 R; 118/620

[56] References Cited

U.S. PATENT DOCUMENTS

| | | | |
|---|---|---|---|
| 2,364,526 | 12/1944 | Hansell | 118/620 |
| 3,058,840 | 10/1962 | Kerr et al. | 118/620 |
| 3,816,938 | 6/1974 | Podkletnov | 34/1 |
| 3,842,234 | 10/1974 | Seyfried | 219/10.79 |

*Primary Examiner*—Larry I. Schwartz

*Attorney, Agent, or Firm*—Cushman, Darby & Cushman

[57] ABSTRACT

Apparatus for drying and/or curing a coating on a metal substrate comprising apparatus for inductively heating the coated substrate in a highly confined space and apparatus for condensing evaporated liquids released as the result of the heating.

16 Claims, 5 Drawing Figures

APPARATUS AND METHOD FOR DRYING AND CURING COATED SUBSTRATES

FIELD OF THE INVENTION

The present invention relates to apparatus and methods for drying and curing coated substrates and more particularly to drying and curing of organically coated substrates.

BACKGROUND OF THE INVENTION

Conventionally, organic coated substrates are cured in hot air ovens in which the substrate is exposed to temperatures of the range of 150–210 degrees Centrigrade for a dwell time of abaout 10 minutes. This conventional curing technique involves the disadvantage that the carrier solvent of the coating is evaporated and produces harmful air pollution if released to the atmosphere.

In practice, most of the hot air containing the solvent vapors is normally recirculated for energy conservation considerations and as a result, the solvent vapors must be incinerated, at a significant cost in energy.

Water based coatings have been developed in an effort to reduce the air pollution resulting from curing. These coatings also include a small proportion of organic solvents and suffer from poor quality, rendering them unsuitable for certain applications such as canning of foods.

Coatings which are curable by exposure to intense ultra-violet radiation are also known. These suffer from the disadvantages of high cost and relatively poor quality which render them unsuitable for interior coating of cans containing foods.

SUMMARY OF THE INVENTION

The present invention seeks to provide apparatus for curing coated substrates which enables high quality solvent based substrates to be dried and/or cured without the disadvantages of prior art techniques and which provides additional economic advantages.

There is thus provided in accordance with a preferred embodiment of the present invention apparatus for drying and/or curing a coating on a metal substrate comprising apparatus for inductively heating the coated substrate in a highly confined space and apparatus for condensing evaporated liquids released as the result of the heating.

The coating may be, for example, conventional solventbased or water-based coatings, such that the evaporated liquids are normally conventional solvents and/or water.

Additionally in accordance with a preferred embodiment of the invention, the apparatus for inductively heating comprises an AC electrical power supply and an induction coil coupled to the power supply and arranged in close physical proximity to the substrate to be or dried and/or cured.

Further in accordance with a preferred embodiment of the present invention, the induction coil is arranged to define a conduit for the flow of coolant therethrough, whereby the induction coil, thus cooled, operates as a condenser for the evaporated liquid, forming part of the apparatus for condensing.

Additionally in accordance with an embodiment of the present invention, the apparatus for condensing is operative to condense the evaporated solvent at approximately atmosphereic pressure.

Further in accordance with an embodiment of the invention, the apparatus for inductive heating provides drying in a dwell time of about 1 second and curing in a dwell time of approximately 3–10 seconds.

Additionally in accordance with an embodiment of the invention, the power supply comprises a high frequency AC power supply operating in the frequency range of 20–450 KHz.

Further in accordance with an embodiment of the invention, there is also provided apparatus for rapid cooling of the coated substrate following curing which may include apparatus for spraying an atomized liquid, such as water droplets, onto the coated substrate.

Additionally in accordance with an embodiment of the invention, there may also be provided apparatus for coating the substrate with the coating prior to heating. This coating device may comprise a dipping bath through which a coil of substrate is caused to pass.

Additionally in accordance with a preferred embodiment of the invention, there is provided a method for heating and/or curing a coated conductive substrate comprising the steps of inductively heating the coated substrate in a highly confined space and condensing evaporated solvent released as the result of the heating.

Additionally in accordance with a preferred embodiment of the invention, the step of inductively heating comprises the step of passing AC electrical power through an induction coil coupled to the power supply and arranged in close physical proximity to the substrate to be dried and/or cured.

Further in accordance with a preferred embodiment of the present invention, the step of condensing comprises the step of causing a flow of coolant through a conduit formed in the induction coil.

Additionally in accordance with an embodiment of the present invention, the step of condensing is operative to condense the evaporated solvent at approximately atmosphereic pressure.

Further in accordance with an embodiment of the invention, the step of inductive heating provides drying in about 1 second and curing in a dwell time of approximately 3–10 seconds.

Additionally in accordance with an embodiment of the invention, the inductive heating step comprises passing high frequency AC power in the frequency range of 20–450 KHz through the induction coil.

Further in accordance with an embodiment of the invention, there is also provided a step of rapid cooling of the coated substrate following curing which step may include spraying a liquid, such as water, onto the coated substrate.

Additionally in accordance with an embodiment of the invention, there may also be provided the step of coating the substrate prior to heating. This coating step may comprise dipping a coiled substrate in a dipping bath.

BRIEF DESCRIPTION OF THE DRAWINGS

The present invention will be understood and appreciated more fully from the following detailed description taken in conjunction with the drawing in which.

DETAILED DESCRIPTION OF THE INVENTION

Figure 1:
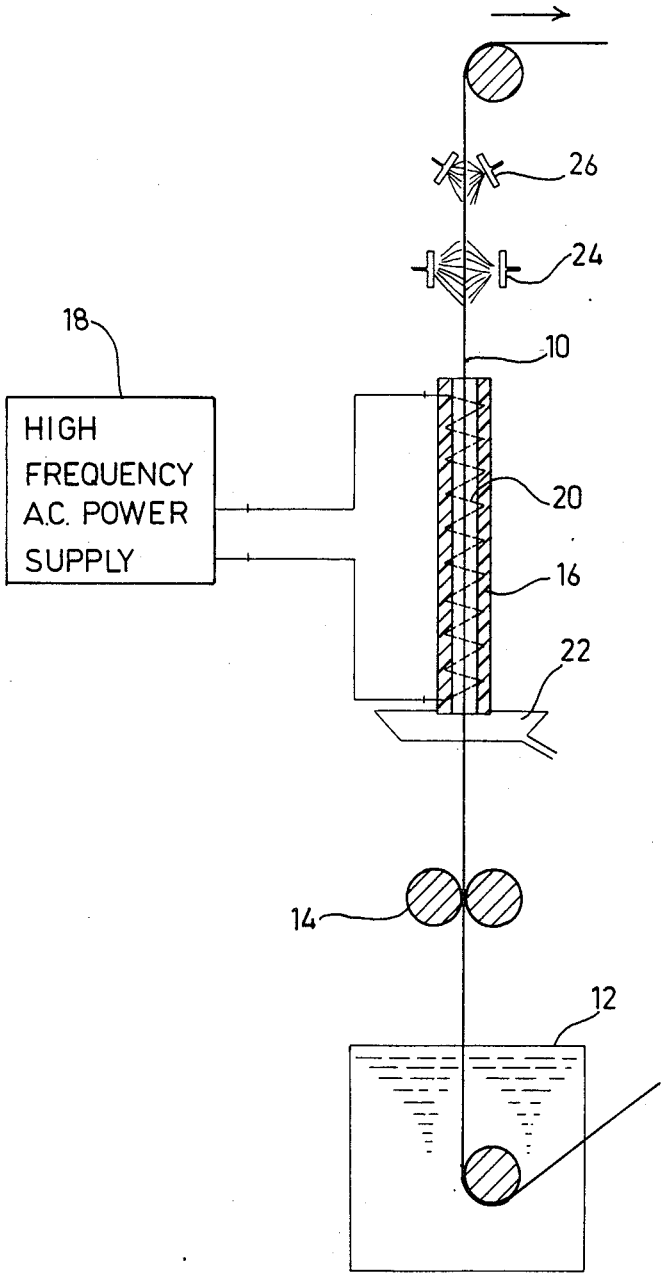
FIG. 1 is a schematic illustration of apparatus for coating and curing a substrate in accordance with a preferred embodiment of the present invention.

Reference is now made to FIG. 1, which illustrates apparatus for coating and curing a web substrate in accordance with a preferred embodiment of the present invention. In the illustrated embodiment, the web substrate is in the form of a coil, such as a coil of tinplate, it being appreciated that sheets of tinplate or other substrate may be coated in a similar manner using conventionally available sheet feeding techniques.

The substrate 10, such as tinplate, is preferably first subjected to surface treatment in accordance with the teachings of applicant's U.S. Pat. No. 4,448,475 and is then supplied to a coating bath 12 which contains a coating material, such as an organic coating which may be entirely solvent based, or partially water based, for example. Excess coating material is allowed to run vertically down the vertically aligned surface of the substrate 10 as it leaves bath 12.

A pair of adjustably positionable rubber rollers 14 serve to remove excess coating material from the substrate surface and to position the substrate. Downstream of rollers 14, the substrate is supplied to a curing unit generally indicated by reference numeral 16.

Figure 3:
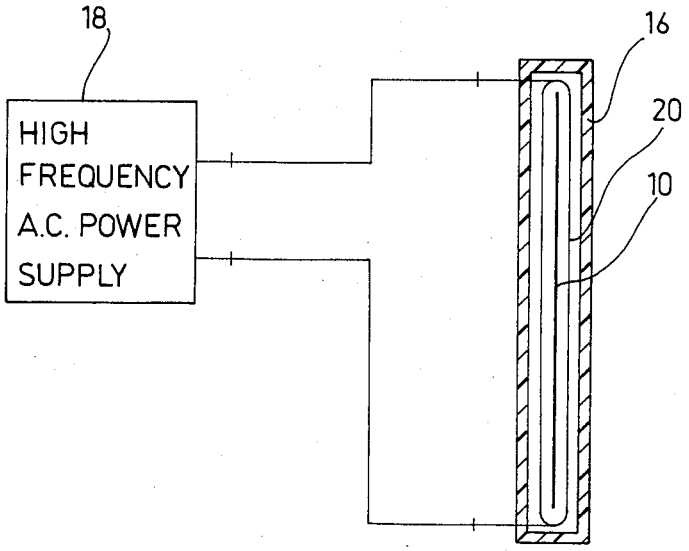
FIG. 3 is a sectional illustration of the arrangement of the induction coils about the substrate in the embodiment of FIG. 1.

According to a preferred embodiment of the present invention, the curing unit comprises a high frequency AC power supply 18 which supplies AC power, typically at a voltage of 440 V and a frequency of 450 KHz through an induction coil 20 which is wound in a generally rectangular cylindrical arrangement, as seen in FIG. 3, so as to define very close tolerances with the substrate passing therethrough but without permitting electrical contact or arcing to take place between the two.

Accordingly, the configuration of the curing unit 16 defines a very small volume which surrounds the substrate during curing thereof. To the extent practical, this volume is sealed from the outside atmosphere. To provide efficient condensation of the saturated vapors therein at ambient temperature and pressure.

Flow of electrical AC current through the induction coil 20 produces induction heating of the conductive substrate 10, thereby heating the substrate, typically to a temperature of about 450–500 degrees Fahrenheit. The heat of the substrate is transmitted to the coating by conduction, thereby producing drying of the coating within about 1 second and curing thereof within about 3–10 seconds. During drying and curing, solvent from the coating is evaporated into the very small volume surrounding the substrate.

In accordance with a preferred feature of the present invention, the induction coil 20 is formed as a hollow tube and defines a conduit through which a cooling liquid can be caused to flow. Typically, this cooling liquid is water at room temperature. The flow of the cooling liquid cools the induction coil 20 and enhances condensation of the evaporated solvent thereon at generally atmospheric pressure. The condensate runs down the induction coil by gravity and is collected at atmospheric pressure in a collection tray 22, which may communicate with a suitable collection assembly for permitting recycling of the condensed solvent. Other evaporated liquids such as water may also be condensed by the same apparatus.

It is a particular feature of the present invention that the provision of a small volume surrounding the substrate during curing and condensation enables enhanced efficiency of condensation and recovery of solvents. The use of induction heating in a small volume provides very significant energy savings, not only in terms of recycled solvents but also in terms of the energy used to heat the substrate. As compared with the prior art, wherein only about 8% of the energy expended went into heating of the substrate, according to the present invention, virtually all of the induction energy goes to heating of the substrate.

Downstream of the curing unit 16 there may be provided an atomized water spray 24 for rapid cooling of the coated, cured substrate. The water spray 24 may be followed by an air blast 26 for providing rapid drying of the coated substrate. The coated substrate may then be recoiled or employed as desired.

Figure 2:
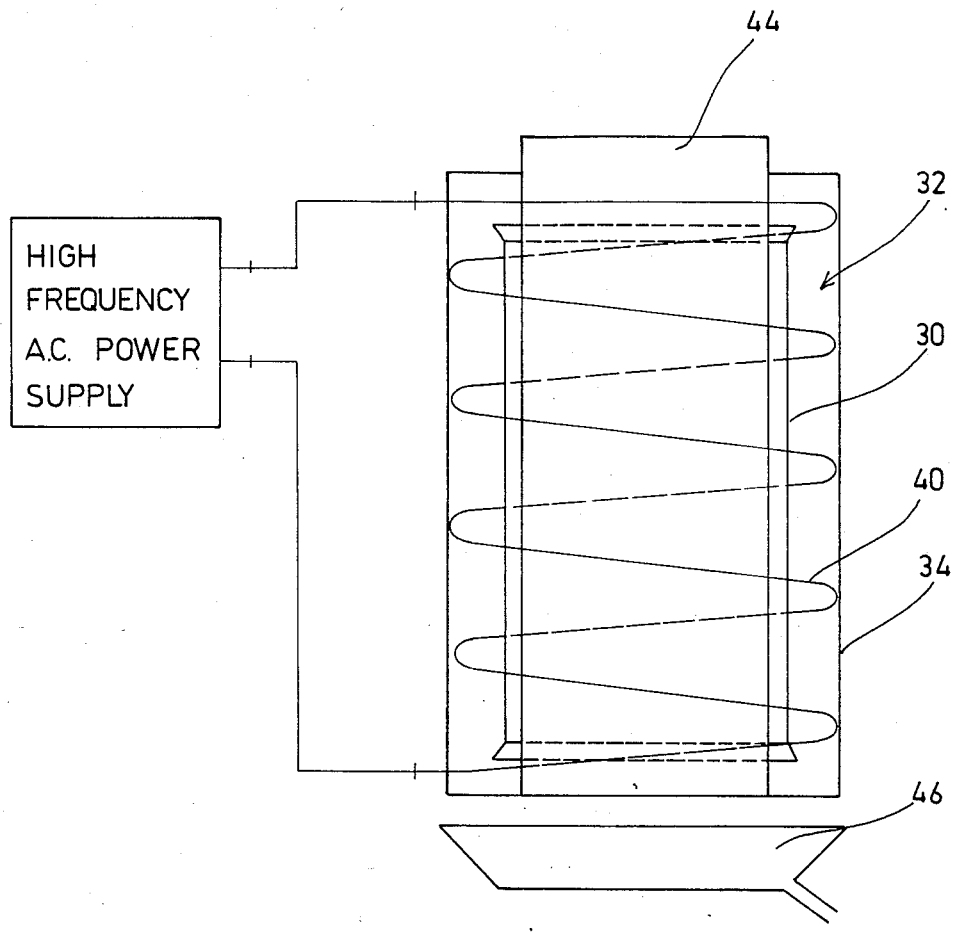
FIG. 2 is a schematic illustration of apparatus for curing an internally coated cylinder in accordance with a preferred embodiment of the invention.
Figure 4:
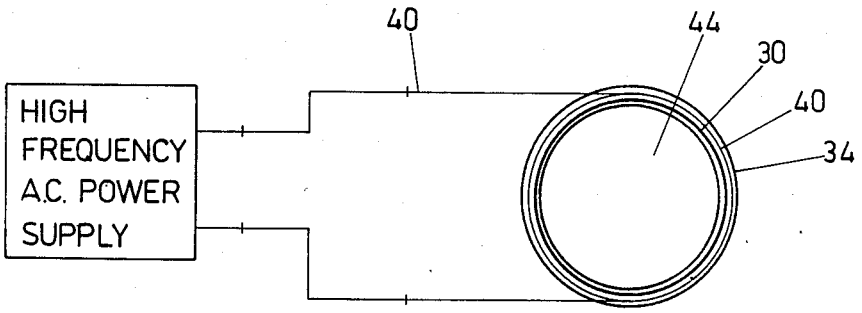
FIG. 4 is a sectional illustration of the arrangement of the induction coils about the substrate in the embodiment of FIG. 2.
Figure 5:
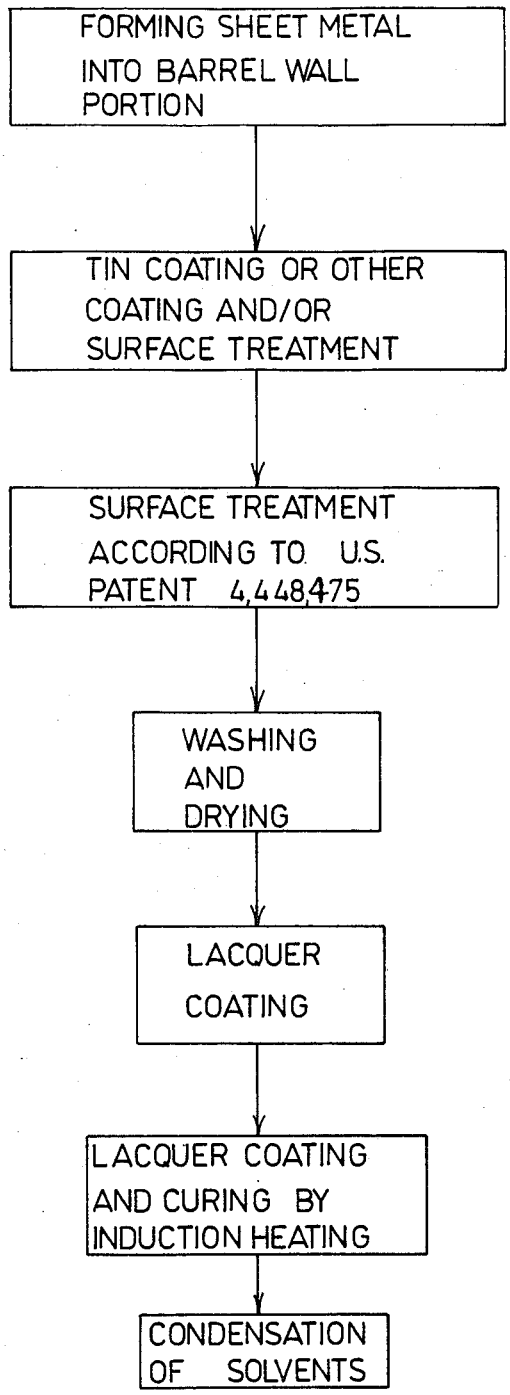
FIG. 5 is a flow chart diagram illustrating the technique of barrel manufacture employing the apparatus of FIGS. 2 and 4.

Reference is now made to FIGS. 2, 4 and 5, which illustrate the apparatus and technique for curing coated barrels in accordance with the present invention. As a first step, sheet metal of a suitable thickness is formed into a cylinder corresponding to a barrel wall portion 30. A tin coating may applied to the cylinder by conventional techniques, such as electroplating. Alternatively any other suitable coating or surface treatment may be applied to the cylinder. One or both surfaces of the barrel wall cylinder may be so coated.

The tin coated surface or surfaces of the barrel wall cylinder are next preferably subjected to surface treatment in accordance with the teachings of applicant's U.S. Pat. No. 4,448,875, the teaching of which is incorporated herein by reference. The cylinder is then washed and dried.

Following the surface treatment and washing and drying steps, the interior and/or exterior surfaces of the barrel wall portion 30 is coated with lacquer by conventional techniques, such as spraying. Following the lacquer coating step, the barrel wall cylinder is inserted into a curing unit of the type illustrated in FIGS. 2 and 4. As seen in FIG. 2, the curing unit, indicated generally by reference numeral 32, comprises a nonconductive housing 34, typically formed of plastic.

Disposed adjacent the interior surface of housing 34 is an induction coil 40, which may be substantially the same in construction and operation as induction coil 20 described hereinabove in connection with the embodiment of FIGS. 1 and 3. The induction coil may include a coolant channel and means for causing a coolant such as water to flow therethrough for cooling thereof and enhanced condensation of evaporated solvent thereon.

The induction coil 40 is coupled to a source of AC electrical power via suitable control apparatus, not illustrated. The barrel wall cylinder 30 to be treated is located interiorly of the induction coil 40.

Disposed interiorly of barrel wall cylinder 30 and closely spaced from the interior wall surface of barrel wall cylinder 10 is a container 44, typically formed of a suitable material such as plastic or metal, which is filled with water or any other suitable liquid. The suitably filled container 44 serves to reduce the volume inside the housing 34 in which the solvent can evaporate from the coating during drying and curing, for the reasons described above in connection with the embodiment of FIGS. 1 and 3.

According to a preferred embodiment of the invention, filled container 44 also defines a relatively cool surface upon which condensation of evaporated solvent can occur. A condensate collector 46 is therefore provided underlying container 44.

Where both inside and outside surfaces of the barrel wall cylinder 30 are sought to be cured or dried, both the container 44 and the cooled induction coil 40 serve as condensation surfaces.

As described hereinabove in connection with the embodiment of FIGS. 1 and 3, solvents released during the lacquer drying and curing step are recovered by condensation thereof at container 44 and/or at the induction coil 40 and are drained and removed from a collector 46.

The lacquer curing step may be carried out simultaneously with a flow brightening step by reaching a substrate temperature of 450–500 degrees Fahrenheit for 10–20 seconds.

The simultaneoous provision of lacquer curing and condensation is a particulaar feature of the present invention, saving costs in equipment, time and space, as well as permitting recycling of the solvents.

The use of induction heating of the substrate in a very restricted volume has the significant advantages of large energy savings and prevention of pollution.

Upon completion of the induction heating step and condensation of the excess solvent, the barrel wall cylinder 10 is then assembled into a complete barrel with top and bottom end portions.

It will be appreciated by persons skilled in the art that the present invention is not limited to what has been particularly shown and described hereinabove. Rather the scope of the present invention is defined only by the claims which follow.

I claim:

1. In an apparatus for drying and/or curing solvent containing coatings on a conductive substrate which comprises:

means for inductively heating the coated substrate in a highly confined space, producing vapors; and the improvement which comprises providing means for recovery of the solvent and thereby simultaneously preventing atmospheric pollution by avoiding incineration of the vapors produced and/or venting them or the incineration products to the atmosphere, characterized by:

cooling means for condensing evaporated liquids released as a result of the heating, which cooling means is disposed around the periphery of the substrate in said highly confined space; and means for removal of the resulting condensed liquids, and wherein said means for inductively heating comprises an AC electrical power supply and an induction coil coupled to the power supply and arranged in close physical proximity to the substrate to be dried and/or cured, said induction coil being arranged to define a conduit for the flow of coolant therethrough, whereby said coil, thus cooled, operates as a condenser for the evaporated liquid, thus forming at least part of said cooling means for condensing.

2. Apparatus for drying and/or curing coatings on a metal substrate according to claim 1 and wherein said coatings comprise solvent-based or water-based coatings.

3. Apparatus for drying and/or curing coatings on a metal substrate according to claim 1 and wherein said cooling means for condensing is operative to condense the evaporated solvent at approximately atmospheric pressure.

4. Apparatus for drying and/or curing coatings on a metal substrate according to claim 1 and wherein said cooling means for condensing is operative to condense the evaporated solvent at approximately ambient temperature.

5. Apparatus for drying and/or curing coatings on a metal substrate according to claim 1 and wherein said apparatus is effective to provide drying in a dwell time of about 1 second and curing in a dwell time of approximately 3–10 seconds.

6. Apparatus for drying and/or curing coatings on a metal substrate according to claim 1 and wherein said power supply comprises a high frequency AC power supply operating in the frequency range of 20–450 KHz.

7. Apparatus for drying and/or curing coatings on a metal substrate according to claim 1 and also comprising means for rapid cooling of the coated substrate following curing.

8. Apparatus for drying and/or curing coatings on a metal substrate according to claim 1 and also comprising means for coating the substrate with the coating or coatings prior to heating.

9. In a method for drying and/or curing coatings on a coated conductive substrate which comprises inductively heating by means of an induction coil the coated substrate in a highly confined space, the improvement which comprises recovery of the solvent and simultaneously preventing atmospheric pollution, by avoiding incineration of the vapors produced and/or venting them or the incineration products to the atmosphere, characterized by the steps of:

condensing in said highly confined space evaporated liquids released as a result of the heating; and removing the resulting condensed liquids from the vicinity of said highly confined space, and wherein said step of condensing comprises the step of causing a flow of coolant through a conduit formed in the induction coil.

10. A method for drying and/or curing coatings on a coated conductive substrate according to claim 9 and wherein the inductive heating comprises passing AC electrical power through an induction coil coupled to the power supply and arranged in close physical proximity to the substrate to be dried and/or cured.

11. A method for drying and/or curing coatings on a coated conductive substrate according to claim 9 and wherein said step of condensing is operative to condense the evaporated liquids at approximately atmospheric pressure.

12. A method for drying and/or curing coatings on a coated conductive substrate according to claim 9 and wherein said step of condensing is operative to condense the evaporated liquids at approximately ambient temperature.

13. A method for drying and/or curing coatings on a coated conductive substrate according to claim 9 which is effective to provide drying in a dwell time of about 1 second and curing in a dwell time of approximately 3–10 seconds.

14. A method for drying and/or curing coatings on a coated conductive substrate according to claim 9 and wherein said inductive heating comprises passing high frequency AC power in the frequency range of 20–450 KHz through the induction coil.

15. A method for drying and/or curing coatings on a coated conductive substrate according to claim 9 and also comprising the step of rapid cooling of the coated substrate following curing.

16. A method for drying and/or curing coatings on a coated conductive substrate according to claim 9 and also comprising the step of coating the substrate prior to heating.

* * * * *